US005604982A

United States Patent [19]

Kent et al.

[11] Patent Number: 5,604,982

[45] Date of Patent: Feb. 25, 1997

[54] METHOD FOR MECHANICALLY EXPANDING ELLIPTICAL TUBES

[75] Inventors: Scott E. Kent, Albion; Michael A. Gavlak, Buffalo, both of N.Y.

[73] Assignee: General Motors Corporation, Detroit, Mich.

[21] Appl. No.: 465,300

[22] Filed: Jun. 5, 1995

[51] Int. Cl.[6] ..... B23P 15/26

[52] U.S. Cl. ..... 29/890.044; 29/890.043; 29/727

[58] Field of Search ..... 29/890.044, 890.043, 29/523, 890.047, 727

[56] References Cited

U.S. PATENT DOCUMENTS

| | | | |
|---|---|---|---|
| 3,603,384 | 9/1971 | Huggins et al. | 165/181 |
| 4,228,573 | 10/1980 | Barnard | 29/157.3 R |
| 4,269,267 | 5/1981 | Labrande | 165/181 |
| 4,570,317 | 2/1986 | Veling et al. | 29/157.3 A |
| 4,692,979 | 9/1987 | Pietzcker | 29/157.3 C |
| 4,815,651 | 3/1989 | Malwitz | 228/173.2 |
| 5,101,561 | 4/1992 | Fuhrmann et al. | 29/890.043 |
| 5,345,674 | 9/1994 | Knecht et al. | 29/890.044 |

FOREIGN PATENT DOCUMENTS

| | | | |
|---|---|---|---|
| WO94/27105 | 11/1994 | WIPO | F28F 1/32 |

*Primary Examiner*—Irene Cuda
*Attorney, Agent, or Firm*—Patrick M. Griffin

[57] ABSTRACT

An elliptical cross section tube of novel construction that is capable of being expanded by a conventional conical tool of the type used to expand round cross section tubes. The tube is also reinforced by integral internal webs. The unexpanded tube cross section has concave lengthwise channels and concave internal webs that are all internally tangent to a circle representing a cross section of the expansion tool's conical head. As the head of the tool is pushed through the tube, it pushes the channels out into the fin hole while flattening the webs. The tube is thus mechanically bonded to the tube, and is left with a pair of internal reinforcing webs.

3 Claims, 5 Drawing Sheets

METHOD FOR MECHANICALLY EXPANDING ELLIPTICAL TUBES

This invention relates to method of heat exchanger manufacture generally, and specifically to an improved method for expanding heat exchanger tubes of non-round, elliptical cross section so as to mechanically join them to cooling fins.

BACKGROUND OF THE INVENTION

An old and cost effective method for joining heat exchanger tubes to thin cooling fins is simple mechanical expansion. As shown in co-assigned U.S. Pat. No. 4,228,573, round, cylindrical tubes are run perpendicularly through round holes in thin cooling fins, all held temporarily in a fixture. An expansion rod with a bullet shaped, generally conical head is then pushed through each unexpanded tube. The largest cross section of the expansion rod is designed to expand the outer surface of the tube tightly into the edge of the fin, thereby securing it, within a short cycle time. The end result is a solid, sound structure, without brazing or welding. While the process is simple and effective, a round tube is not as thermally efficient as a generally elliptical or oval cross section tube, which has a greater ratio of surface area to volume.

Tubes with elliptical or oval cross sections are typically brazed to the cooling fin, which is effective, but more expensive and time consuming than mechanical expansion. However, there are issued patents that propose various methods for mechanically expanding elliptical tubes. U.S. Pat. No. 3,603,384 shows an extruded tube that has a stadium shaped cross section, with flat top and bottom walls and a central internal partition. Initially, the top and bottom walls are folded inwardly, about deep internal surface grooves that serve as hinge lines. Then, a pressurized medium is introduced into the tube to pop the kinked walls back flat and tightly into the edge of the fin hole. It is unlikely that internal pressure could ever create a sufficiently tight expansion of the tube walls into the edge of the fin hole, and certainly not as efficiently as simply pushing an expansion tool through the tube.

More practical proposals simply expand a tube of elliptical cross section into a matching fin hole with a rod that has an expansion head with a continually increasing elliptical cross section. This is the logical and obvious extension of expanding a round tube with an expansion tool of continually increasing circular cross section. An example may be seen in U.S. Pat. No. 4,560,317. The problem with such an approach is that the elliptical cross section tube is not nearly so resistant to either internal burst pressure or external crushing forces as is a round tube. Therefore, the heat exchanger shown in the U.S. Pat No. 4,560,317 patent is suitable as a low pressure radiator, not a high pressure condenser. Another patent discloses what might be referred to as a reverse ellipse, an oval tube with concave, rather than convex walls. It would also be expanded with a simple tool having a matching cross section. The reverse shape is claimed to be more pressure resistant, but as with any mechanically expanded, non-round tube, it cannot have integral internal strengthening walls, unless they are brazed in later. Another patent, U.S. Pat. No. 4,692,979 expands the tube with an elliptical expander, and then puts an unbonded spacer down the middle of the expanded tube, in the same location as the central tube partition of U.S. Pat. No. 3,603,384. While an unbonded spacer would resist crushing, it would not, of course, do anything at all to resist internal burst pressure. The design would, therefore, not be suitable for a high pressure condenser, either.

The lack of strength of mechanically expanded elliptical tubes highlights the real objective of the internal pressure tube expansion process disclosed in U.S. Pat. No. 3,603,317, which is to allow the use of the kind of internal, integral strengthening partition that is not possible with known methods of mechanical expansion. In summary, the current state of the art of non-brazed elliptical tubes offers a choice between inefficient tube expansion or tubes with insufficient strength.

SUMMARY OF THE INVENTION

The invention provides an elliptical cross section tube with integral, internal strengthening webs that can be mechanically expanded by a tool pushed axially through the tube. Moreover, the elliptical tube can be expanded with a conventional, conical expander of circular cross section, even though the largest cross section of the expander is much smaller than the total cross sectional area of the tube.

In the preferred embodiment disclosed, the cooling fin is a thin metal plate with a series of elliptical holes cut through it, one for each tube. The outline of each fin hole is defined relative to a longer, horizontal major axis, a shorter, vertical minor axis, and a center point where the axes cross.

Each tube has an unexpanded cross section that is generally elliptical and symmetrical to the outline of the fin hole, although shorter and thinner, with a perimeter clearance all the way around. In its unexpanded state, the tube has a pair of opposed concave channels formed along its length, generally bisected by the minor axis. The channels have a predetermined ridge to ridge internal separation. The tube also has an opposed pair of initially concave integral webs running the full length of the tube interior, which are bisected by the major axis. The webs have an initial ridge to ridge internal separation substantially equal to that of the channels.

To assembly the heat exchanger, the fins are aligned in a fixture with the tubes centered within the fin holes. Expander rods are pushed axially through the tubes, as they would be with round tubes. The head of the tool fits between the channels and webs and drags along the equally spaced ridges thereof simultaneously. Both the thickness and length of the tube cross section increase as the channels and webs are progressively flattened. The channels eventually merge into the elliptical outline of the expanded edge of the fin hole. The end result is a tube that is tightly secured to the fin, and which also has a pair of spaced, integral webs strengthening it against internal burst pressure.

DESCRIPTION OF THE PREFERRED EMBODIMENT

These and other features of the invention will appear from the following written description and drawings, in which.

Figure 1:
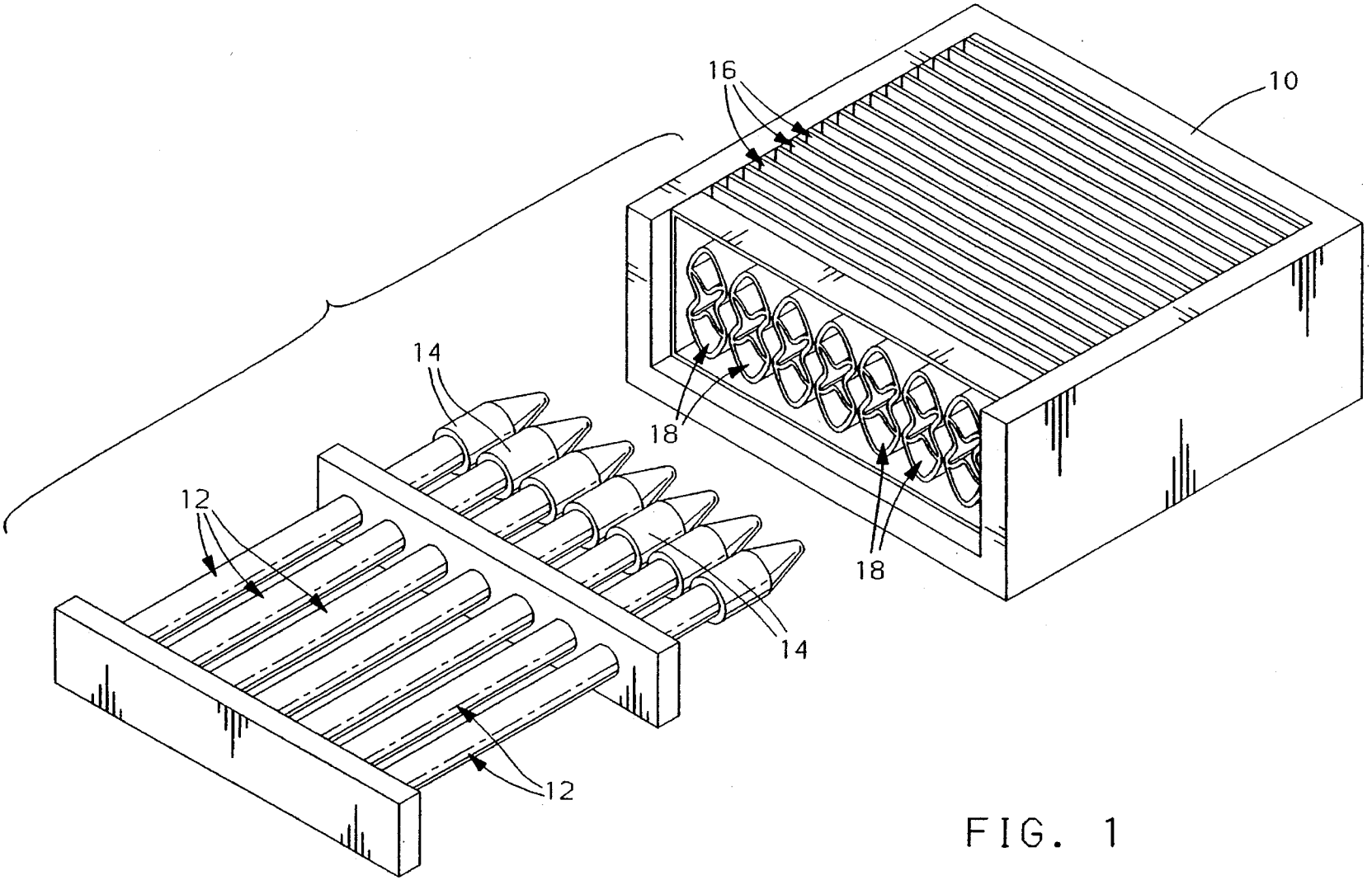
FIG. 1 is a perspective of a holding fixture, series of expander rods, and a collection of fins and tubes according to the invention, prior to expansion.

Referring first to FIG. 1, a basically conventional tube and fin expansion fixture 10 and an array of expansion rods, each indicated generally at 12, are shown. Each rod 12 is basically the same as would be used with a round tube, and has a conically shaped head 14 the cross section of which progressively grows from a small rounded point to a largest diameter circle. Fixture 10 holds a regularly spaced series of cooling fins, indicated generally at 16, and unexpanded tubes, indicated generally at 18. The fixture 10 not only holds the fins 16 temporarily in position, but very solidly anchors the tubes 18 so that the rod heads 14 can be pushed axially through them with force. Details of the fins 16 and tubes 18 are described next.

Figure 2:
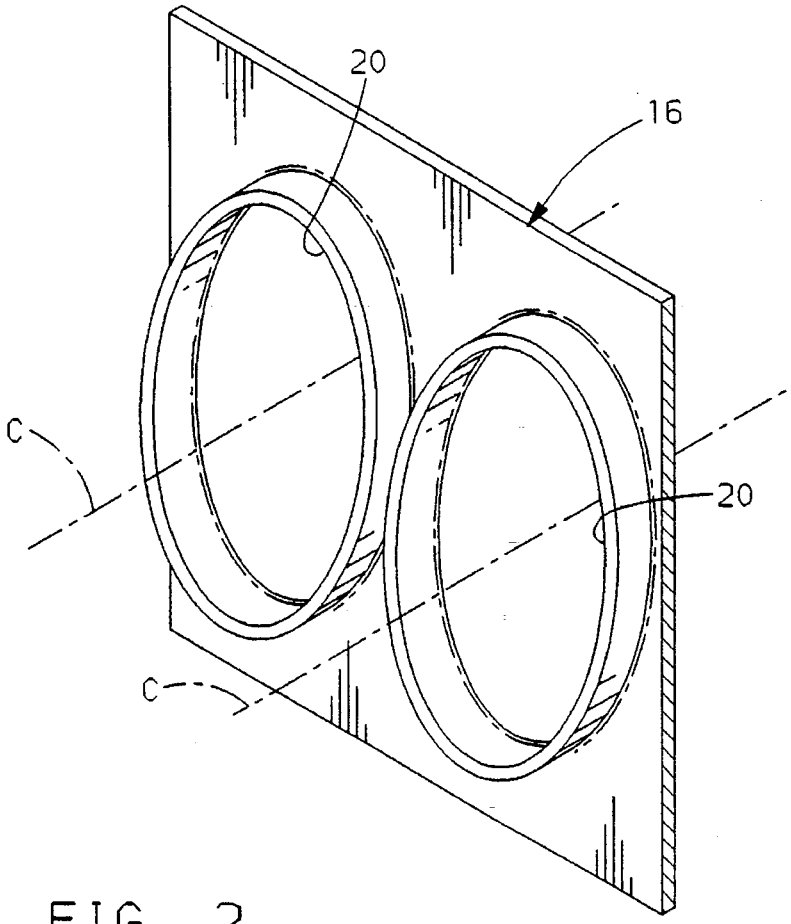
FIG. 2 is a perspective view of a section of cooling fins showing two fin holes.
Figure 4:
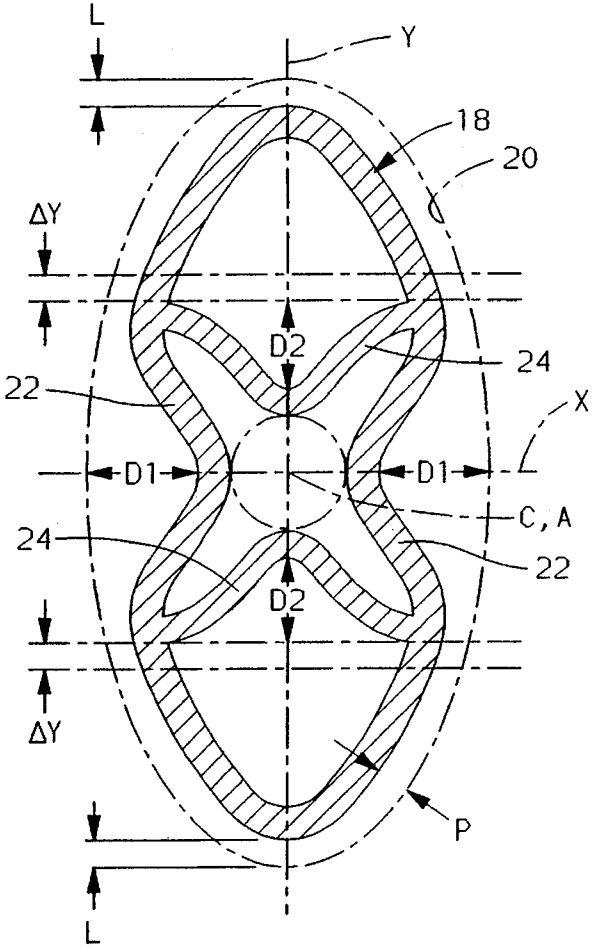
FIG. 4 is a cross section of an unexpanded tube shown centered within the outline of a fin hole, shown by a dotted ellipse.

Referring next to FIGS. 2 and 4, each fin 16 is a flat, thin, conductive metal plate, preferably aluminum. Fin 16 has a regularly spaced series of elliptical holes 20 punched through it, each of which consists of a short, axially protruding collar, rather than a sharp edge. This is typical, since the protruding collar provides more surface area to make mechanical and conductive contact when the tubes 18 have been expanded. The outline of hole 20, meaning the two dimensional profile of the inner surface of the collar that define hole 20, is shown in FIG. 4 as a dotted line. Hole 20 is basically elliptical, though it need not be a mathematically precise ellipse. As such, the outline of hole 20 can be defined as having a length measured along a horizontal major axis Y, a width (or thickness) measured along a vertical minor axis X, and a center point C. The terms major and minor axis are used below both in a dimensional sense, as in the vertical thickness of the fin hole 20 being its minor axis, and in a directional sense, as in motion or measurement occurring along the axes. Preferably, the outline of hole 20 would be an ellipse with an aspect ratio of about two to one, or with length about twice the width, making it shorter and thicker than the typical elliptical tube.

Figure 3:
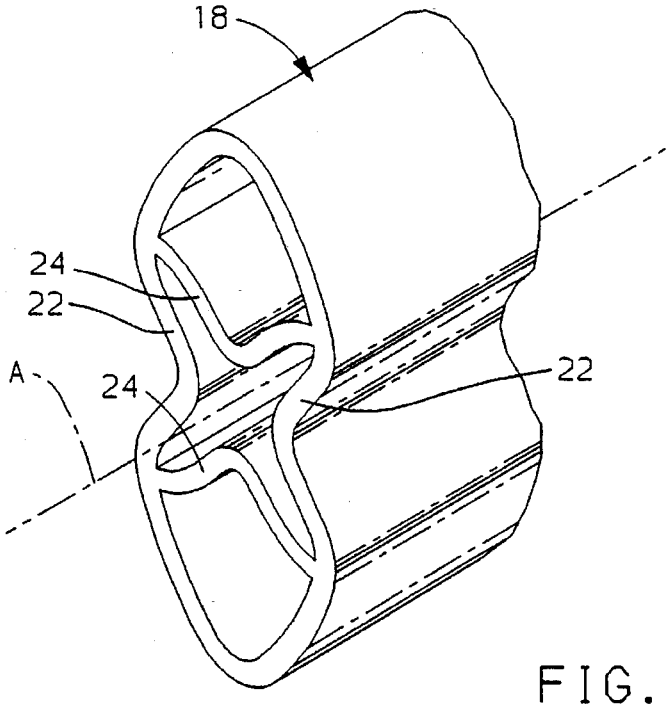
FIG. 3 is a perspective view of the end of an unexpanded tube.

Referring next to FIGS. 3 and 4, each tube 18 is an integral extrusion, also preferably aluminum, and so has a constant cross sectional shape everywhere along its central axis A. The cross sectional shape of tube 18, in its unexpanded state, can be defined as generally elliptical, although it will be, at least initially, not a perfect ellipse, even if fin hole 20 is. Still, the shape of tube 18 can be best described, in terms of length and width, relative to the same reference frame used above to describe fin hole 20. To that end, FIG. 4 shows the cross section of the unexpanded tube 18 centered within the dotted line outline of fin hole 20, with A and C coincident. The cross section of unexpanded tube 18 is both shorter along the Y axis, and narrower along the X axis, than the outline of fin hole 20, as well as having a basically constant perimeter clearance all the way around. The length differential (meaning half of the total length differential) is indicated at L, and the perimeter clearance at P. No specific clearance amount or formula need be given, and the various clearances would be basically the same as the perimeter clearances used with elliptical tubes in the past. The perimeter clearance is discontinuous at two points, increasing significantly where a pair of opposed channels 22 run the length of tube 18. The channels 22 are concave as viewed from the outside of tube 18, and are centered on a plane containing the minor axis X. Each channel 22 has a predetermined depth measured from the outline of fin hole 20 inwardly along the minor axis to the ridge, and indicated at D1. D1 must be less than half of the length of the minor axis X, so that the ridges of the opposed channels 22 do not touch internally. The D1 depth is still a significant percentage of the thickness of fin hole 20 as measured along the minor axis, in the range of one fourth to one third. The basic requirement determining the depth and width of the channel 22 is that it include enough total material to be capable, as it is flattened, of pushing the ends of the tube cross section far enough apart to close up the length differential L at each end. So, the channel 22 can be made narrower and deeper, or wider and less deep, so long as it includes sufficient material. Tube 18 is also extruded with a continuous pair of opposed internal webs 24 that generally match the shape of the channels 22. Before expansion, the webs 24 are also concave, as viewed looking toward C, and are centered on a plane containing the major axis Y. The webs 24 have a depth D2 measured inwardly along the major axis Y to their ridge that is less than D1, less by an amount approximately equal to the depth differential L defined above. This lesser depth takes into account the fact that the webs 24 will shift outwardly and apart when tube 18 is expanded and flattened during assembly, ultimately ending up on a plane that is shifted an amount delta Y outwardly from the original location of the webs 24. Delta Y, in turn, is approximately equal to L. As with the channels 22, the prime factor governing the depth and width of web 24 is that it contain enough material to be able to lengthen enough to make up the perimeter clearance P as the web 24 is flattened. It is also important that the channels 22 and webs 24 be located and oriented so that their ridges are all internally tangent to an imaginary circle, shown in dotted lines, and centered on C. The circle C would have a diameter which was approximately equal the length of the minor axis minus the depth of both channels 22, allowing for material thickness. In fact, a way to more simply conceptualize the interrelationship of the pairs of opposed channels 22 and webs 24 is that they have an equal internal ridge to ridge separation, equal to the diameter of inscribed circle to which they are tangent. The absolute value of that circle diameter is not so important as the fat that a circle can be inscribed that touches on all four ridges internally, the significance of which is described next.

Figure 5A:
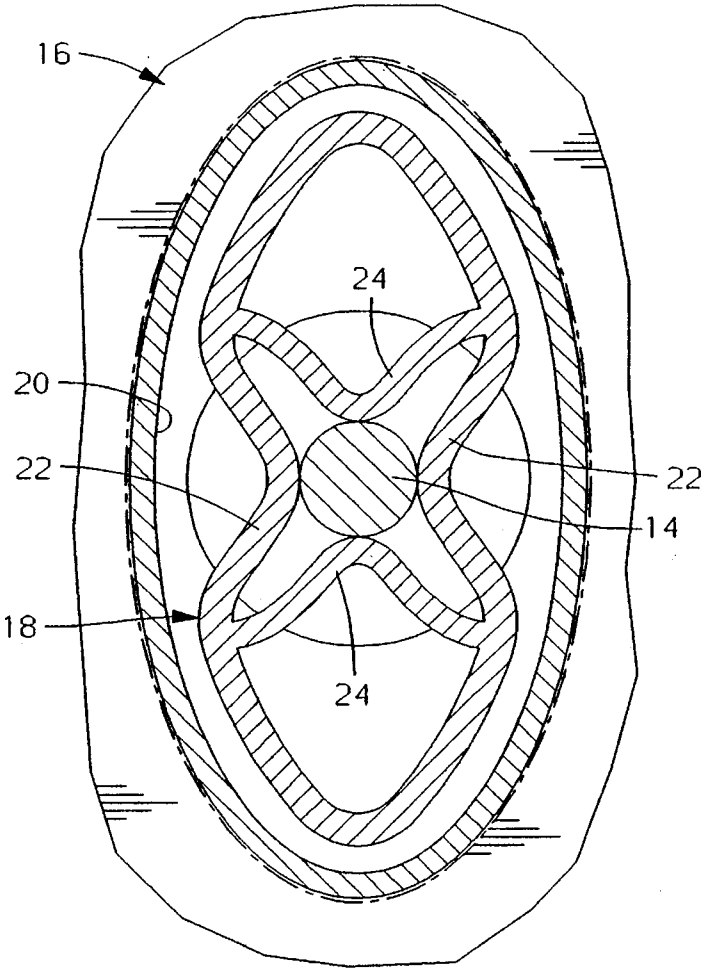
FIG. 5A is a cross section through a tube, fin hole edge, and expansion tool, showing the beginning of the tube expansion operation.
Figure 5C:
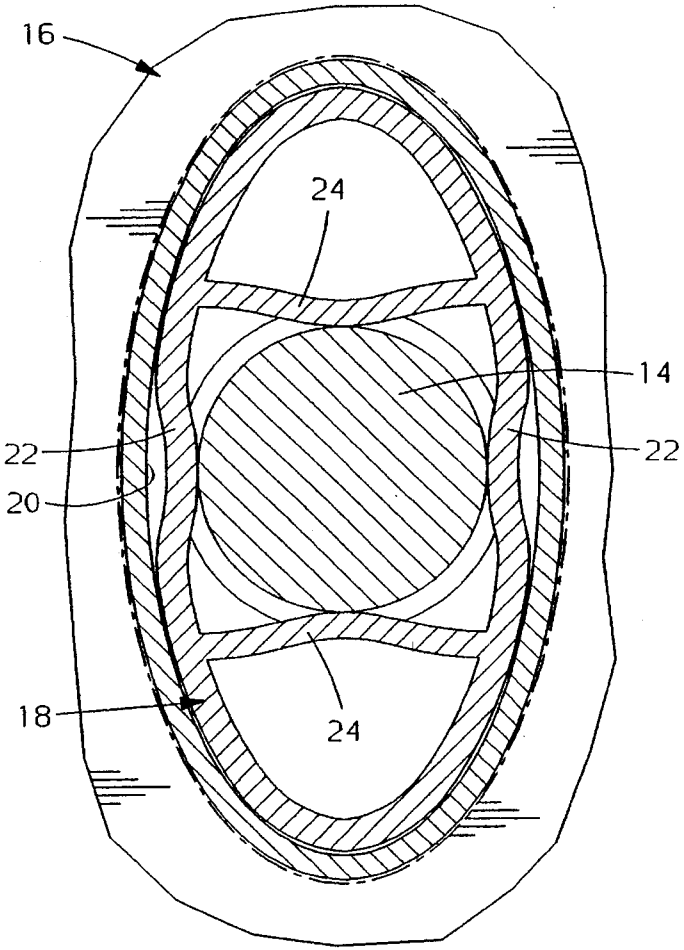
FIG. 5C shows the expansion process nearly completed.
Figure 5B:
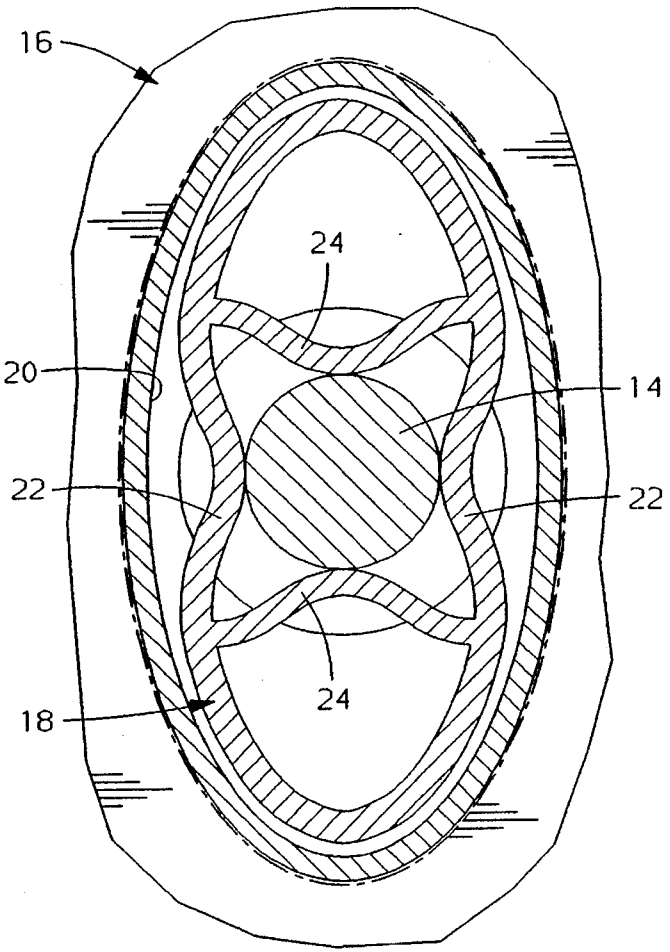
FIG. 5B shows the expansion process further along.

Referring next to FIGS. 5A through 5D, the expansion of tube 18 is illustrated. The rod head 14 is pushed forcefully through and along the axis of tube 18, just as it would be for a conventional round tube. Unlike prior art elliptical tube expanders, the rod head 14 is conical and pointed, much smaller than the total internal area of tube 18, and can fit inside of the channels 22 and webs 24 without being blocked. FIGS. 5A through 5D shows the result over time at a planar cross section of tube 18 that corresponds to the plane of a cooling fin 16. The same expansion of the tube 18 occurs everywhere along its length, of course, but is most significant at the planes coincident with the cooling fins 16. At any plane, when the rod 14 has advanced to the point where its cross sectional diameter equals the inscribed circle described above, it begins to drag on the ridges of the channels 22 and webs 24 concurrently, and so forces the channels 22 and webs 24 outwardly simultaneously, as seen in FIG. 5A. As this occurs, the progressive flattening of the channels 22 forces the tube 18 to expand lengthwise, that is, along the Y axis, as well as increasing its thickness along the X axis. At the same time, the progressive flattening of the webs 24 pushes out directly on the tube 18 in a direction parallel to the X axis, thickening it along the X axis. The webs 24 shift outwardly and apart along the Y axis as the tube 18 expands. Both FIGS. 5B and 5C illustrate this progressive flattening of the channels 22 and webs 24. While the motion of rod 12 is exactly what it would be for a round tube, it may actually see less resistive force, since it bears on the inside of tube 18 only along four relatively thin areas, and not along the entire interior circumference, as it would with a round tube. The webs 24 help to support the elliptical shape of that portion of tube 18 that is located outboard of them, so that the channels 22 can be pushed out without buckling or otherwise misshaping the remainder of tube 18. Finally, as can be seen by comparing FIGS. 5C and 5D, when the largest diameter of the expansion rod head 14 passes the plane of the fin 16, the material in the channels 22 is pushed out far enough to reverse curvature and become convex, and so merge into the outline of fin hole 20. Concurrently, the entire outer surface of tube 18 moves out enough to close up the original perimeter clearance P and contact the collar that forms the edge of fin hole 20. The webs 24 do not reverse curvature, but simply flatten out.

Figure 5E:
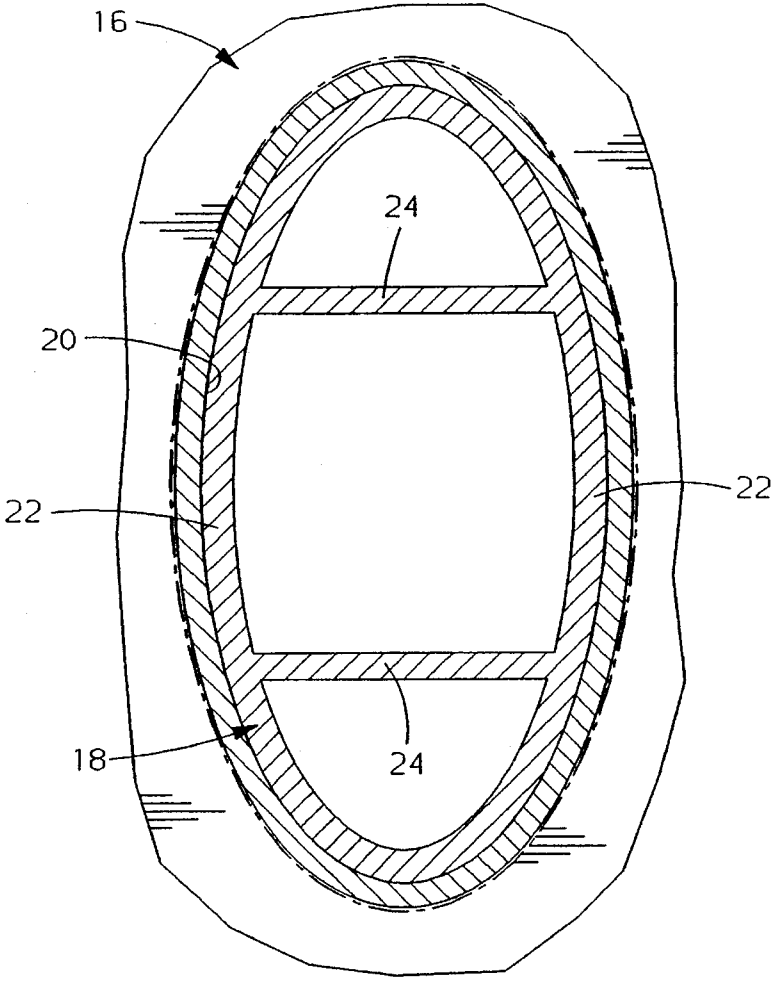
FIG. 5E shows the expanded tube with the tool removed.
Figure 5D:
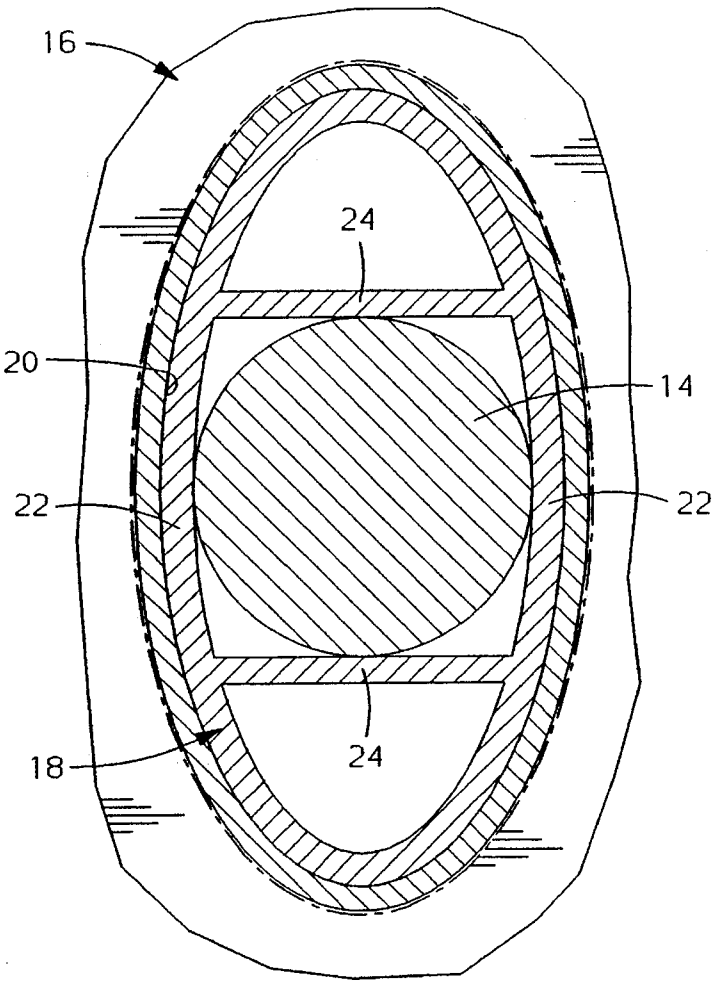
FIG. 5D shows the expansion process completed.

Referring next to FIGS. 1 and 5E, the end result of the expansion process is illustrated. The rods 12 are pulled out, and the tubes 18 are left solidly, mechanically fused to the fins 16, in the same orientation as in FIG. 1. No assembly or installation steps are necessary beyond what would be done for a conventional round tube and fin. Specifically, as the tube 18 expands, it is plastically deformed, meaning that it will not spring back significantly toward its original shape. The fin hole 20, on the other hand, meaning the protruding collar that defines it, is elastically deformed, and remains under resilient tension. Therefore, the original outline of fin hole 20 is slightly smaller than the profile to which tube 18 will ultimately be expanded, but the differential is visually insignificant, less than ten thousandths of an inch. One new factor, as compared to a standard round tube expansion, is that as the channels 22 reverse curvature toward the end of their expansion, there will be a quick bulging and shrinking of the Y axis length of the tube cross section. This could cause a temporary discontinuity in the elastic deformation of the edge of fin hole 20. However, by careful matching of the fin hole 20 size to the profile of the expanded tube 18, the natural elasticity of fin 16 should be sufficient to accommodate that temporary discontinuity. What is new is not the tube-fin bond per se, but the novel tube shape that allows it to be expanded with a conventional tool that would seemingly be totally inappropriate to the task. Another novel aspect of the tube 18 is that, when finished, it is reinforced by the same webs 24 that helped support its shape during the expansion process, just as it would be by a separately added brazed insert. The expanded tube 18 is thus protected against both external crushing forces and internal bursting forces, and therefore suitable for any heat exchanger application, not just low pressure applications.

In conclusion, the assembly process afforded by the novel unexpanded tube configuration is completely transparent to the operator, and carried out just as a conventional tube expansion operation would be. Likewise, the actual extrusion of the tube 18, once its design was set, would be totally conventional. The most difficult part of the process would be the actual design of the unexpanded tube configuration, the determination of the depths, widths, and initial locations of the channels 22 and webs 24. But that would be a one time expenditure of time, insignificant when amortized over the entire production. No hard and fast formula can be given for setting those parameters, which would best be done by a combination of theoretical work, such as finite element computer analyses, and actual empirical testing. In general, the unexpanded shape and size of tube 18 would be best determined through a series of backward iterative approximations. For example, in a computer simulation, a width and depth for the channels 22 would be chosen that generally met the percentage of minor axis length defined above, a circle inscribed, and then a location and depth for concave web 24 would be chosen so that their ridges touched the same circle. Then, the circle would be expanded to see how the channels and webs responded. Depths and shapes would be changed until a suitable end result was obtained, which would be confirmed later with working models. It might well be more effective to design the tube 18 to expand out to a certain elliptical shape, and then match the outline of the fin hole 20 to it.

Variations of the embodiment disclosed could be made. The internal webs could have a different cross sectional shape, so long as they still had an initial internal separation, measured along the major or Y axis, that matched the internal, ridge to ridge separation of the concave channels measured along the X axis. For example, the webs could be initially C shaped and convex, not concave, each of which was a semicircle that generally matched the largest diameter of the expansion rod head 14. The head 14 would still evenly and symmetrically drag along and push apart the webs as it pushed out the channels. Such webs would not be flat and vertical when the tube expansion was complete, however. The webs 24 disclosed are advantageous in that their post expansion flat shape is the most efficient structural reinforcer. The expansion rod head 14 could have further details superimposed on its basic conical shape, such as four wedge shaped wipers that would trail the conical portion of the head and drag along the four inside comers of the flattened webs 24. The basic expansion process would be the same, however. The webs 24 need not flatten out entirely, though it would be potentially counter productive if the expander tool pushed so far outward against them as to reverse their curvature slightly. That would tend to contract the outer surface of the tube 18, and so jeopardize the mechanical bond to the fin 16. Other aspect ratios for the ellipse could be chosen, although 2 to 1 seems to be effective. The interior surface of tube 18 could be formed with short, conduction enhancing internal fibs, on every surface except those directly borne upon by the expander head 14. Therefore, it will be understood that it is not intended to limit the invention to just the embodiment disclosed.

We claim:

1. A method for mechanically joining an elongated heat exchanger tube to a heat dissipating fin that is oriented generally perpendicular to said tube, comprising the steps of, forming an opening in said fin having a generally elliptical outline with a center point, a major axis and a minor axis, forming said tube with a central length axis coincident to said center point and a generally elliptical cross section of similar shape to, but smaller initial perimeter outline than, said fin opening outline, said tube having, in an unexpanded state, a pair of opposed concave channels running the length of said tube and substantially centered on a plane containing said minor axis, with a ridge to ridge internal separation less than said minor axis, said tube also having a pair of internal webs running the length of said tube spaced evenly to either side of a plane containing said minor axis, each of said webs having an initial internal separation, measured along said major axis, comparable to said channel separation, providing an expansion rod with a generally conical head the circular cross section of which increases continuously in diameter along the axis of said conical head, said head having a largest diameter circular cross section generally equal to the minor axis of said fin opening outline, holding said unexpanded tube and fin in a fixture with said tube central axis extending perpendicularly through and generally centered within said fin opening, forcefully pushing said expansion rod through said tube along its central length axis, thereby forcing said expansion rod head between and through said opposed tube channels and webs and expanding said concave channels to a convex shape matching said tube opening outline while simultaneously engaging said webs and pushing them apart, thereby expanding said tube out tightly into said fin opening and joining said tube to said fin.

2. A method for mechanically joining an elongated heat exchanger tube to a heat dissipating fin that is oriented generally perpendicular to said tube, comprising the steps of, forming an opening in said fin having a generally elliptical outline with a center point, a major axis and a minor axis, forming said tube with a central length axis coincident to said center point and a generally elliptical cross section of similar shape to, but smaller initial perimeter outline than, said fin opening outline, said tube having, in an unexpanded state, a pair of opposed concave channels running the length of said tube and substantially centered on a plane containing said minor axis, with a ridge to ridge internal separation less than said minor axis, said tube also having a pair of concave internal webs running the length of said tube spaced evenly to either side of a plane containing said minor axis, said webs and channels all being tangent to an inscribed circle centered on said central length axis, providing an expansion rod with a generally conical head the circular cross section of which increases continuously in diameter along the axis of said conical head, said head having a largest diameter circular cross section generally equal to the minor axis of said fin opening outline, hold said unexpanded tube and fin in a fixture with said tube central axis extending perpendicularly through and generally centered within said fin opening, forcefully pushing said expansion rod through said tube along its central length axis, thereby forcing said expansion rod head between and through said opposed tube channels and webs and expanding said concave channels to a convex shape matching said tube opening outline while simultaneously engaging said webs and pushing them apart, thereby expanding said tube out tightly into said fin opening and joining said tube to said fin.

3. A method for mechanically joining an elongated heat exchanger tube to a heat dissipating fin that is oriented generally perpendicular to said tube, comprising the steps of, forming an opening in said fin having a generally elliptical outline with a center point, a major axis and a minor axis, forming said tube with a central length axis coincident to said center point and a generally elliptical cross section of similar shape to, but smaller initial length and thickness than, said fin opening outline, said tube having, in an unexpanded state, a pair of opposed concave channels running the length of said tube and substantially centered on a plane containing said minor axis, each tube wall channel having a predetermined depth, measured from the outline of said fin hole outline and inwardly along said minor axis, said tube also having a pair of concave internal webs running the length of said tube spaced evenly to either side of a plane containing said minor axis, each of said webs having a depth, measured inwardly along said major axis that is substantially equal to said predetermined depth less half the length differential between said unexpanded tube cross section and said fin hole outline, providing an expansion rod with a generally conical head the circular cross section of which increases continuously in diameter along the axis of said conical head, said head having a largest diameter circular cross section generally equal to the minor axis of said fin opening outline, holding said unexpanded tube and fin in a fixture with said tube central axis extending perpendicularly through and generally centered within said fin opening, forcefully pushing said expansion rod through said tube along its central length axis, thereby forcing said expansion rod head between and through said opposed tube channels and webs and expanding said concave channels to a convex shape matching said tube opening outline while simultaneously flattening said concave webs, thereby expanding said tube out tightly into said fin opening and joining said tube to said fin.

* * * * *